United States Patent [19]

Dewsnap

[11] 4,266,677

[45] May 12, 1981

[54] SAMPLES CLAMP

[75] Inventor: Paul D. Dewsnap, New York, N.Y.

[73] Assignee: Donaldson Display Company, Inc., South Hackensack, N.J.

[21] Appl. No.: 4,894

[22] Filed: Jan. 19, 1979

[51] Int. Cl.[3] ..... A47F 7/16

[52] U.S. Cl. ..... 211/45; 24/346; 211/113; 223/85

[58] Field of Search ..... 211/45, 113; 223/85, 223/92; 24/84 R, 84 A, 84 B, 85 R, 85 B

[56] References Cited

U.S. PATENT DOCUMENTS

| | | | |
|---|---|---|---|
| 2,186,811 | 1/1940 | Uhlmann | 24/84 B |
| 2,215,139 | 9/1940 | Uhlmann | 24/84 B X |
| 2,370,391 | 2/1945 | Boltan et al. | 211/113 |
| 3,755,859 | 9/1973 | Solari | 24/84 B |
| 3,963,154 | 6/1976 | Schwartz et al. | 223/85 |

FOREIGN PATENT DOCUMENTS

| | | | |
|---|---|---|---|
| 216957 | 9/1958 | Australia | 85/DIG. 2 |
| 556327 | 4/1958 | Canada | 85/DIG. 2 |
| 1239188 | 4/1967 | Fed. Rep. of Germany | 211/45 |
| 2115051 | 9/1972 | Fed. Rep. of Germany | 211/45 |
| 2400867 | 7/1975 | Fed. Rep. of Germany | 211/45 |
| 858615 | 11/1940 | France | 24/84 R |

*Primary Examiner*—Roy D. Frazier
*Assistant Examiner*—Robert W. Gibson, Jr.

[57] ABSTRACT

The tamper-proof samples clamp of the invention includes a holder section that is foldable into a pair of substantially parallel spaced clamp elements having apertures which, when the clamp elements are in their parallel relationship, are in alignment. At least one pin element projects from one of the clamp elements and possesses sufficient stiffness such that it can penetrate the material of samples positioned between the clamp elements. Self-locking fasteners are provided that are dimensioned and configured for insertion through each set of aligned apertures for drawing and locking the clamp elements in clamping engagement with the samples therebetween. A hanger structure is connectable with the holder section for rotatably supporting same and the samples clamped between the clamp elements.

11 Claims, 3 Drawing Figures

SAMPLES CLAMP

BACKGROUND OF THE INVENTION

The present invention relates to samples clamps and more particularly to a tamper-proof samples clamp.

Samples clamps have been in widespread use for many years. Such clamps generally consist of a pair of plate-like elements having apertures therein which, when aligned, permit the insertion of screw fasteners or the like through the aligned apertures to clamp carpet or fabric samples therebetween. The samples are usually provided with grommeted openings to receive the screw fasteners. However, not infrequently prospective customers and competitors remove the screw fasteners and pilfer desired ones of the samples. Such thefts are often unnoticed unless careful periodic inspections of the samples clamp are made or unless the theft is discovered accidentally. It will be appreciated that the loss of such samples has an adverse effect upon sales and that the replacement of the missing samples represents at the very least an inconvenience in terms of cost and time.

SUMMARY OF THE INVENTION

It is one object of the invention to provide a samples clamp for the display of samples which is of simple construction and affords security against theft of the samples.

It is another object of the invention to provide a samples clamp particularly well adapted for the display of carpet and fabric samples which permits easy assembly of the samples and affords security against theft of such samples.

It is yet another object of the invention to provide a samples clamp of the character described which is easily manufactured, can receive the samples in a simple manner and afford security against theft of the samples.

Other objects and advantages of the invention will become readily apparent to persons versed in the art from the ensuing description.

According to the present invention, there is provided a tamper-proof samples clamp comprising: a holder section foldable into a pair of substantially parallel spaced clamp elements and at least one set of apertures in said clamp elements which are in alignment when said clamp elements are disposed in parallel relationship; at least one pin element carried by at least one of said clamp elements having sufficient stiffness to permit penetration of the material of samples positioned between the clamp elements for securing such samples in place; self-locking fastening means dimensioned and configured for insertion through each set of said aligned apertures to thereby draw and lock said clamp elements into clamping engagement with the samples therebetween; and hanger means for rotatably supporting said holder section and the samples clamped between said clamp elements.

BRIEF DESCRIPTION OF THE DRAWINGS

In order that the invention may be more fully comprehended it will now be described, by way of example, with reference to the accompanying drawings in which.

DESCRIPTION OF THE PREFERRED EMBODIMENTS

Figure 1:
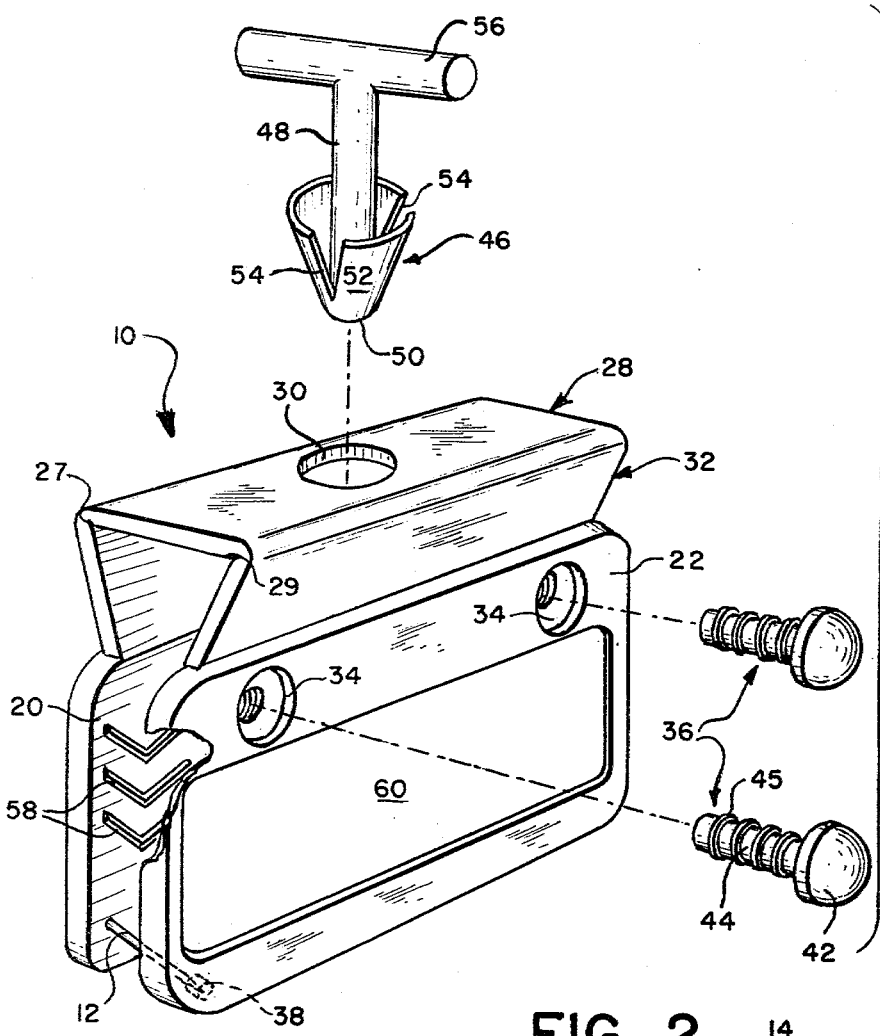
FIG. 1 is an exploded perspective view of a samples clamp embodying the features of the invention.

Referring to the drawings there is shown a samples clamp identified generally by reference numeral 10. The clamp is particularly well adapted for use with samples of carpets, fabrics and like materials which can be penetrated by a pin member such as pin member 12 to be described.

The samples clamp is desirably fabricated from a synthetic plastic material such as polypropylene so as to permit manufacture of the article by one of the conventional molding techniques thereby enabling greatly reduced unit cost. Further, the design of the samples clamp lends itself to such molding techniques since, except for the hanger and fastening elements, it is a one-piece device and can be molded in a single step.

Figure 3:
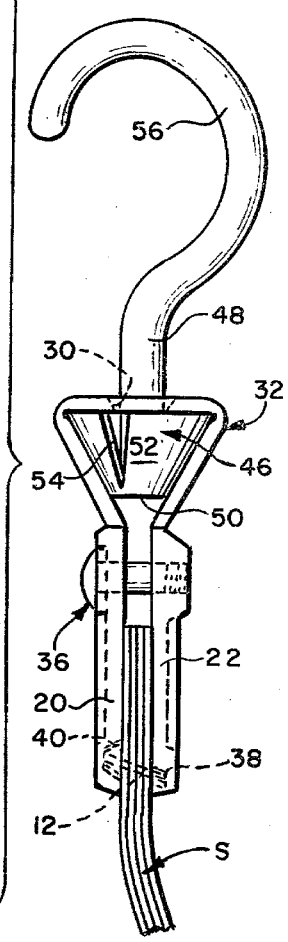
FIG. 3 is a side elevational view of the samples clamp of the invention with a plurality of samples clamped therewithin for display and also showing a different type of hanger configuration.
Figure 2:
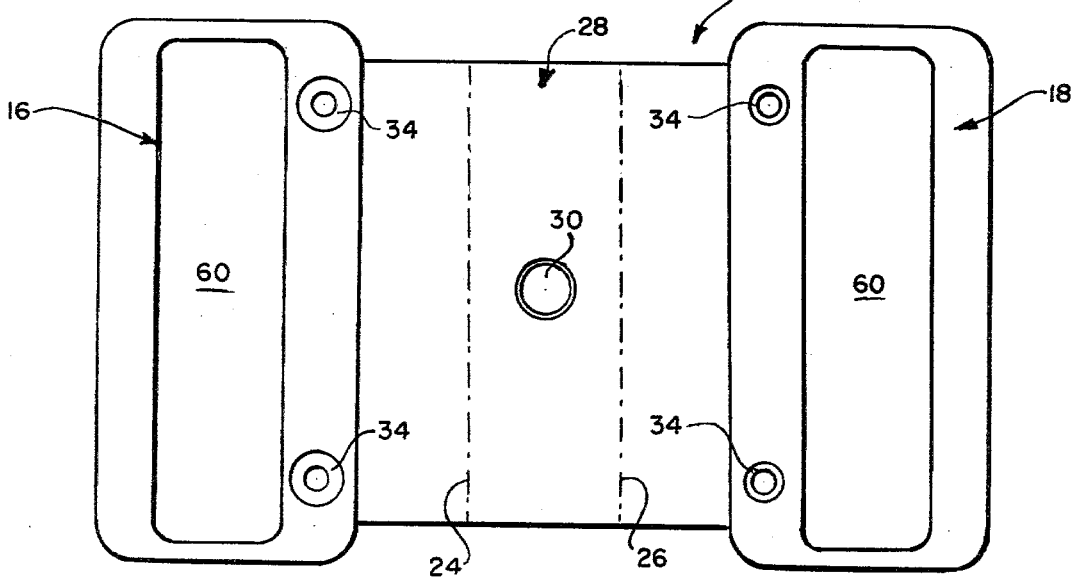
FIG. 2 is a top plan view of the holder section and connecting bracket section of the samples clamp prior to being folded into configuration to receive the samples.

As can be seen from FIG. 2, the principal components of the samples clamp are desirably incorporated in a single blank 14 and, in the presently preferred form of the invention, is fabricated from a synthetic plastics material by injection molding. The blank is preferably formed with a pair of regions 16, 18 at its opposed longitudinal extremities of generally rectangular configuration. Such regions, when the blank is folded into the form shown in FIGS. 1 and 3, provide a pair of substantially parallel clamp elements 20, 22 which are spaced from each other. To facilitate folding of the blank into the intended configuration a pair of weakened zones 24, 26 are desirably formed in the central section 28 of the blank such as by molding the blank with transversely extending grooves 27, 29 as can be seen in FIG. 1. However, it will be understood that any other expedient for expediting folding of the blank into the form shown in FIGS. 1 and 3 may be adopted as may be deemed appropriate.

The blank 14 is formed with central section 28 connected between regions 16, 18 and with an aperture 30 therein for a purpose which will become clear. When the blank is folded into the configuration shown in FIGS. 1 and 3 central section 28 serves as a bracket section 32 surmounting and integral with clamp elements 20, 22. The aperture 30 is formed at the geometric center of the central section and is desirably given a slight taper to approximately complement the taper of the wall of a head element on a hanger described hereinafter. Such tapered constructions of the aperture and wall facilitates assembly of the hanger with the bracket section 32 and serves also to assure retention of the hanger.

The blank 14 is provided with at least one and preferably, as shown most clearly in FIGS. 1 and 3, two sets of apertures 34 which, when the blank is folded for use, are in alignment. With the clamp elements 20, 22 juxtaposed as shown in FIGS. 1 and 3 the apertures are located in the upper portion of each clamp element remote from the lower edge and proximate the lateral extremities of the clamp element. The apertures 34 are desirably countersunk to at least partially accommodate the head of a self locking stud fasteing member 36.

At least one of the clamp elements 20, 22 is given one or more pin elements 12 which project therefrom. Such pin elements, in the presently preferred form of the invention, are tapered staples which are positioned by being fired through the wall of the clamp element at a predetermined location by means of a staple gun. Such pin elements should possess sufficient stiffness to penetrate the material of the samples S to be held by the clamp. It is preferred that the pin elements project from only one of the clamp elements and that there be formed in the inner wall of the opposing clamp element a recess 38 having adequate depth to receive the free end of each pin element. It will be understood, of course, that in certain instances such as when the thickness of the sample materials is great, the clamp elements may be spaced a distance apart so that the pin element does not reach recess 38. However, under normally expected usage the pin elements 12 will be of sufficient length to penetrate all of the sample material and to extend therebeyond so as to enter the recess in the wall of the opposing clamp element. Further, it is within the ambit of the invention to fabricate blank 14 with one or more of pin elements 12 integral therewith so as to obviate the need for firing the pin element through the wall of the clamp element. However, to facilitate use of the staple gun the wall of the clamp element may be initially formed with a pocket 40 so that the pin element need not encounter the full thickness of the wall when fired into position.

An important component of the samples clamp of this invention is provision of a self-locking stud member 36 for each set of aligned apertures 34. Each stud member is dimensioned and configured such that it can be inserted though a set of apertures 34 and once so inserted is lockingly retained therein while drawing the clamp elements 20, 22 into clamping engagement with the samples therebetween. The preferred form of self-locking fastening member is shown clearly in FIG. 1 and includes a head 42 which may be semi-round or of any other suitable shape to avoid risk of personal injury to individuals using the samples clamp. A shank 44 extends axially from the head 42 and a plurality of raised ribs 45 are formed circumferentially about the shank and are given a configuration such that once the stud fastener is inserted through the aligned apertures, desirably under a predetermined degree of force, the rib most closely adjacent to the outer wall of the second of the clamp elements penetrated will lock behind such clamp element and thereby prevent withdrawal of the fastening stud. It will be appreciated that a variety of configurations for such ribs is possible to provide for this self-locking effect and there would appear to be no reason to encumber the specification with such details of construction. The construction shown in FIG. 1 is particularly useful because it enables utilization of the fastening stud with various thicknesses of the samples material, locking being possible at a number of penetration depths of the fastening stud. Insertion of the fastening stud through the apertures occurs at a point above the uppermost edges of the samples material so that there is no need to provide corresponding openings in such samples. As stated earlier, the fastener stud is inserted a sufficient distance to draw clamp elements 20, 22 together into clamping engagement with the samples material therebetween, and locking of the rib behind the outer wall of the adjacent clamp element, coupled with penetration of pin element 12 through the sample material, serves to securely position the sample material and prevent removal of same from the samples clamp.

In order that the samples clamp may be easily carried or otherwise supported such as on a pipe rack or the like, a hanger structure is provided. The hanger includes a resilient head element 46 and a shaft 48 projecting axially therefrom. The shaft is dimensioned so as to be freely insertable through aperture 30 and rotatable therewithin. The head element 46 comprises a dished member having a base 50 from which a peripherally extending wall 52 projects upwardly and outwardly in tapered fashion. At least one and preferably at least two slots 54 are formed in wall 52, each such slot commencing at the upper edge of the wall and extending inwardly to terminate at a location proximate base 50. In the presently preferred embodiment of the invention a pair of slots 54 are formed at diametrically opposed locations in the wall. Preferably each of the slots diverges outwardly away from the base.

A grasping element 56 is formed at the outer extremity of shaft 48 and may take any of a variety of forms. As depicted in FIG. 1 the grapsing element has the shape of a transversely extending bar whereas in FIG. 3 the grapsing element is in the shape of a hook. It will be recognized that the precise shape is not of critical consequence and may be configured as desired. Insertion of the head element 46 through aperture 30 requires some degree of force since the flared upper portion of wall 52 is of greater diameter than that of the aperture. However, since the head element is resilient its diameter will decrease as the wall transverses the aperture. Once entirely through aperture 30 the wall 52 resumes its initial shape and head element 46 is locked behind bracket section 32. Due to the clearance between shaft 48 and the annular edge of aperture 30 clamp elements 20, 22 and the samples clamped therebetween are rotatable 360° for convenient handling and viewing of the sample materials.

It is within the ambit of the invention to provide the inner surfaces of clamp elements 20, 22 with a pattern of ridges 58 or the like to enhance the gripping and clamping engagement between the clamp elements and the sample material; however, by suitable location of apertures 34 in the walls of the clamp elements it is contemplated that adequate clamping engagement will be provided without the need for roughened pattern 58. It is also within the scope of the invention to so locate apertures 34 in the clamp elements 20, 22 such that the device can be used with samples already provided with openings therein as is customary. In such instances the shank 44 will pass through the openings in the sample materials; however, the self-locking effect of fastening member 36 and the positioning and clamping effect of pin element 12 and clamping elements 20, 22 enhance the support of the sample materials.

As can be seen most clearly from FIGS. 1 and 2 an area 60, which may be recessed as shown in FIG. 1, is available for use in displaying various types of information such as company name, classification indicia for the sample material, etc.

Although the embodiments illustrated have been described in terms of their fabrication from a synthetic plastics material it will be appreciated that the article can be fabricated from other materials, e.g. metal whereby the blank shown in FIG. 2 can either be stamped out or die cast. Further, although only a raised rib construction has been shown and described for the fastening stud it will be apparent that other constructions which will afford the desired self-locking effect can be employed. For example, a series of spaced resilient heads such as are used in the hanger construction constitutes an alternative self-locking construction.

Although several embodiments and variations have been suggested herein, others will be obvious to those skilled in this art. Accordingly, the present disclosure should be taken as illustrative only and not as limiting of the scope of this invention.

What I claim is:

1. A tamper-proof samples clamp comprising:

a holder section foldable about itself into at least one pair of substantially parallel spaced clamp elements having at least one set of apertures which are in alignment when said clamp elements are disposed in parallel relationship;

at least one metal pin element integrally carried by one of said clamp elements and a recess formed in the wall of the other clamp element opposite said pin element, having sufficient stiffness to permit penetration through the entirety of the material of samples positioned between the clamp elements and a length sufficient to enter the opposing recess such that each pin element will be supported within its corresponding recess and be cooperable therewith, for securing such samples in place;

self-locking fastening means dimensioned and configures for insertion through each set of said aligned apertures to thereby draw and lock said clamp elements into clamping engagement with the samples therebetween; and hanger means for supporting said holder section and the samples carried by the samples clamp.

2. A samples clamp according to claim 1, wherein said clamp elements comprise plate-like members and at least two apertures are formed in each clamp member, said apertures being located in the upper portion of each clamp membrane remote from the lower free edge thereof.

3. A samples clamp according to claim 1, including roughening means formed on the inner surfaces of said clamp elements for enhancing the clamping engagement of said clamp elements with the material of the samples.

4. A samples clamp according to claims 1 or 2, wherein each said fastening means comprises a headed stud member having an axially extending shank which is provided with at least one circumferentially extending raised rib, each said rib being configured and dimensioned to permit insertion of the shank through a set of said aligned apertures under predetermined pressure in a first direction and prevent withdrawal thereof from said apertures in the opposite direction.

5. A samples clamp according to claim 1 or 2 wherein said hanger means includes a bracket section connected between said clamp elements and having an aperture formed therein, said hanger means further including a hanger comprising a resilient head element insertable forcibly from one side of the bracket section through the aperture therein so as to be positionable lockably on the other side of the bracket section, a shaft integral with and projecting axially from said head element so as to extend through the aperture in said bracket section, and a grasping element at the outer extremity of said shaft whereby the samples clamp can be carried or otherwise supported.

6. A samples clamp according to claim 5, wherein said head element comprises a dished member having a base and a peripherally extending wall projecting upwardly and outwardly from said base, at least one axially extending slot formed in said wall, each said slot opening into the upper edge of the wall and extending downwardly to terminate at a location spaced from said base.

7. A samples clamp according to claim 6, including two of said slots formed at diametrically opposed locations in said wall.

8. A samples clamp according to claim 6, wherein the aperture in said bracket section is tapered to approximately complement the taper of the wall of said head element.

9. A samples clamp according to claim 7, wherein each of said slots diverges outwardly away from said base.

10. A tamper-proof samples clamp comprising:

a holder section foldable about itself into a pair of substantially parallel spaced clamp elements and at least one set of apertures in said clamp elements which are in alignment when said clamp elements are disposed in parallel relationship;

at least one metal pin element tapered toward the free end thereof integral with at least one of said clamp elements and having sufficient stiffness to permit penetration through the entirety of the material of samples positioned between the clamp elements for securing such samples in place;

a recess formed in the wall of each clamp element opposite a clamp element provided with said pin element, each said pin element having a length sufficient to enter the corresponding recess such that each pin element will be supported within its corresponding recess and be cooperable therewith in preventing withdrawal of samples from the samples clamp;

self-locking fastening means dimensioned and configured for insertion through each set of said aligned apertures to thereby draw and non-releasably lock said clamp elements into clamping engagement with the samples therebetween;

and hanger means for supporting the samples clamp, said hanger means including a bracket section connected between said clamp elements and having an aperture formed therein, a hanger having a resilient head element insertible forcibly from one said of the bracket section through the aperture therein so as to be positionable lockably on the other side of the bracket section, said head element comprising a disced member having a base and a peripherally extending wall projecting upwardly and outwardly from said base, at least one axially extending slot formed in said wall, each said slot opening into the upper edge of the wall and extending downwardly to terminate at a location spaced from said base, and a shaft integral with and projecting axially from said head element so as to extend through the aperture in said bracket section, the aperture in said bracket section being tapered to approximately complement the taper of the wall of said head element, and a grasping element at the outer extremity of said shaft whereby the samples clamp can be carried or otherwise supported.

11. A samples clamp according to claim 10, wherein two of said slots are formed at diametrically opposed locations in the wall of said head element.

* * * * *